US009651063B2

(12) United States Patent
Joung et al.

(10) Patent No.: US 9,651,063 B2
(45) Date of Patent: May 16, 2017

(54) PRIORITY CONTROL SYSTEM FOR CONSTRUCTION MACHINE

(75) Inventors: Hea-Gyoon Joung, Busan (KR); Young-Bog Song, Changwon-si (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 396 days.

(21) Appl. No.: 14/349,452

(22) PCT Filed: Oct. 7, 2011

(86) PCT No.: PCT/KR2011/007440

§ 371 (c)(1),
(2), (4) Date: Apr. 3, 2014

(87) PCT Pub. No.: WO2013/051741

PCT Pub. Date: Apr. 11, 2013

(65) Prior Publication Data

US 2014/0245730 A1 Sep. 4, 2014

(51) Int. Cl.

| | |
|---|---|
| ***F15B 11/00*** | (2006.01) |
| ***F15B 13/02*** | (2006.01) |
| ***F02D 29/04*** | (2006.01) |
| ***E02F 9/22*** | (2006.01) |

(Continued)

(52) U.S. Cl.

CPC ..... *F15B 13/021* (2013.01); *E02F 9/2037* (2013.01); *E02F 9/2225* (2013.01); *E02F 9/2228* (2013.01); *E02F 9/2282* (2013.01); *E02F 9/2285* (2013.01); *E02F 9/2292* (2013.01); *E02F 9/2296* (2013.01); *F02D 29/04* (2013.01); *F15B 11/16* (2013.01);

(Continued)

(58) Field of Classification Search

CPC ..... F15B 11/162; F15B 13/022
USPC ..... 91/531, 513
See application file for complete search history.

(56) References Cited

U.S. PATENT DOCUMENTS

| | | | | |
|---|---|---|---|---|
| 4,335,577 | A | 6/1982 | Lobmeyer et al. | |
| 7,921,764 | B2 * | 4/2011 | Takeshita | E02F 9/2225 91/513 |

FOREIGN PATENT DOCUMENTS

| | | | |
|---|---|---|---|
| JP | 64-021204 | A | 1/1989 |
| JP | 06010376 | A | 1/1994 |
| JP | 2008261373 | A | 10/2008 |

(Continued)

OTHER PUBLICATIONS

Machine Translation of Japanese Patent Publication 06-010376.*

(Continued)

*Primary Examiner* — Thomas E Lazo
*Assistant Examiner* — Daniel Collins
(74) *Attorney, Agent, or Firm* — Hauptman Ham, LLP

(57) ABSTRACT

Disclosed is a lower track for mounting rubber pads on a track shoe to be attachable and detachable after assembling a steel plate which is adhered with divisionally formed rubber pads as a single unit without additionally perforating coupling through-holes in the track shoe when the rubber pad which forms the lower track and the track shoe which is formed of a metal material are coupled. The lower track of a crawler excavator according to the present invention comprises: first and second rubber pads which are divisionally formed; a first steel plate which supports the bottom surface of the first rubber pad by surrounding the same, and has first hooks formed on the bottom surface thereof and coupling holes formed in a connection stepped-portion.

11 Claims, 5 Drawing Sheets

(51) Int. Cl.
*F15B 11/16* (2006.01)
*E02F 9/20* (2006.01)

(52) U.S. Cl.
CPC ..... *F15B 2211/20546* (2013.01); *F15B 2211/3116* (2013.01)

(56) References Cited

FOREIGN PATENT DOCUMENTS

| | | | |
|---|---|---|---|
| JP | 2010242796 | A | 10/2010 |
| KR | 1020050066039 | A | 6/2005 |
| KR | 100779367 | B1 | 11/2007 |
| KR | 1020110072587 | A | 6/2011 |
| WO | 2010146866 | A1 | 12/2010 |

OTHER PUBLICATIONS

Japanese Office Action for application No. 2014-534450 dated Jul. 30, 2015.
European Search Report for Application No. 11873615.6 dated mailed Apr. 28, 2015.
International Search Report mailed May 18, 2012 for PCT/KR2011/007440.

* cited by examiner

PRIORITY CONTROL SYSTEM FOR CONSTRUCTION MACHINE

CROSS REFERENCE TO RELATED APPLICATION

This application is the National Phase application of International Application No. PCT/KR2011/007440 filed on Oct. 7, 2011, which is incorporated herein by reference in its entirety.

FIELD OF THE INVENTION

The present invention relates to a priority control system for a construction machine. More particularly, the present invention relates to a priority control system for a construction machine, in which when a swing apparatus of an excavator and a work apparatus or an attachment such as the arm are simultaneously manipulated, the priority control valve is shifted to a throttle state or a throttle release state depending on the amount of a load occurring in the hydraulic actuator so that an unnecessary pressure loss can be prevented.

BACKGROUND OF THE INVENTION

A priority control system for a construction machine in accordance with the prior art as shown in FIG. 1 includes:

first and second variable displacement hydraulic pumps (hereinafter, referred to as "first and second hydraulic pumps") 2 and 3 connected to an engine 1 and a pilot pump 4;

a boom control valve 7 configured to control the drive of a boom cylinder 6, a bucket control valve 9 configured to control the drive of a bucket cylinder 8, and a traveling control valve 11 configured to control the drive of a left traveling motor 10, wherein the boom control valve, the bucket control valve, and the traveling control valve are installed in a first center bypass path 5 of the first hydraulic pump 2 so as to be connected to each other through a parallel flow path 5*a;* a swing control valve 14 configured to control the drive of a swing motor 13, an arm control valve 16 configured to control the drive of an arm cylinder 15, and a traveling control valve 18 configured to control the drive of a right traveling motor 17, wherein the swing control valve, the arm control value, and the traveling control valve are installed in a second center bypass path 12 of the second hydraulic pump 3 so as to be connected to each other through a parallel flow path 12*a;* first and second pressure generation devices 19 and 20 configured to output a control signal corresponding to a manipulation amount, respectively;

a shuttle valve 23 configured to output a larger pilot signal pressure selected from pilot signal pressures applied to the swing control valve 14 so that the swing motor 13 can be swung in a left or right direction in response to the manipulation of the first pressure generation device (i.e., swing manipulation lever) 19; and a priority control valve 21 installed in a flow path 29 between the parallel flow path 12*a* on the second hydraulic pump 3 side and an inlet port of the arm control valve 16, and configured to be shifted to a throttle state or a throttle release state by a pilot signal pressure outputted from the shuttle valve 23 when the swing motor 13 and the arm cylinder 15 are simultaneously manipulated.

When the first pressure generation device 19 is not manipulated and thus the pilot signal pressure is not applied to the swing control valve 14, the priority control valve 21 is maintained in the throttle release state by the elastic force of the valve spring 21*a* (see FIG. 1), so that the opening amount of the spool of the priority control valve 21 is switched maximally. On the other hand, when the pilot signal pressure from the shuttle valve 23 is applied to the priority control valve 21 through the flow path 22 due to the manipulation of the first pressure generation device 19, an internal spool of the priority control valve 21 is shifted to the top on the drawing sheet to cause the priority control valve to be shifted to the throttle state.

When the swing motor generating a high load and the arm cylinder generating a low load to perform an arm-in driving operation are simultaneously manipulated, a load occurring in the arm cylinder 15 is relatively higher than that occurring in the swing motor 13. Thus, a flow rate of the hydraulic fluid discharged from the second hydraulic pump 3 supplied to the arm cylinder 15 having a relatively low load is higher than a flow rate as supplied to the swing motor 15.

In order to prevent this, when the swing operation and the arm-in driving operation are simultaneously performed, the priority control valve 21 is shifted to the throttle state so that a flow rate of the hydraulic fluid supplied to the arm control valve 16 from the second hydraulic pump 3 is reduced and a flow rate of the hydraulic fluid supplied to the swing control valve 14 is increased as much as the reduced flow rate of the hydraulic fluid.

For this reason, when the swing motor 13 generating a high load and the arm cylinder generating a relatively low load to perform an arm-in driving operation are simultaneously manipulated, simultaneous manipulability can be maintained.

In the meantime, even when the swing motor 13 generating a high load and the arm cylinder generating a high load to perform an arm-out driving operation are simultaneously manipulated, the priority control valve 21 is maintained in the throttle state by the pilot signal pressure applied thereto due to the manipulation of the first pressure generation device 19. As a result, there is caused a problem in that the flow path of the priority control valve 21 connected to the arm control valve 16 is reduced, leading to a degradation of the operating speed of the arm cylinder 15 and an unnecessary pressure loss, thereby causing a hydraulic energy loss.

DETAILED DESCRIPTION OF THE INVENTION

Technical Problems

Accordingly, the present invention has been made to solve the aforementioned problem occurring in the prior art, and it is an object of the present invention to provide a priority control system for a construction machine, in which when a swing apparatus generating a high operating pressure and an arm generating a high or low operating pressure depending on the driving direction are simultaneously manipulated, the priority control valve is shifted to a throttle state to maintain simultaneous manipulability or is shifted to a throttle release state to prevent an unnecessary pressure loss and secure the operating speed of the hydraulic actuator depending on the amount of a load occurring in the hydraulic actuator so that the distribution of the hydraulic fluid can be controlled optimally.

Technical Solution

To accomplish the above object, in accordance with a first embodiment of the present invention, there is provided a priority control system for a construction machine, including:

an engine;

first and second variable displacement hydraulic pumps connected to the engine and a pilot pump;

a boom control valve configured to control the drive of a boom cylinder, a bucket control valve configured to control the drive of a bucket cylinder, and a traveling control valve configured to control the drive of a left traveling motor, wherein the boom control valve, the bucket control valve, and the traveling control valve are installed in a first center bypass path of the first hydraulic pump so as to be connected to each other through a parallel flow path;

a swing control valve configured to control the drive of a swing motor, an arm control valve configured to control the drive of an arm cylinder, and a traveling control valve configured to control the drive of a right traveling motor, wherein the swing control valve, the arm control value, and the traveling control valve are installed in a second center bypass path of the second hydraulic pump so as to be connected to each other through a parallel flow path;

first and second pressure generation devices configured to output a control signal corresponding to a manipulation amount, respectively;

a shuttle valve configured to output any one selected from pilot signal pressures applied to the swing control valve so that the swing motor can be swung in a left or right direction in response to the manipulation of the first pressure generation device; and a priority control valve installed in a flow path between the parallel flow path on the second hydraulic pump side and an inlet port of the arm control valve, and configured to be switched to a throttle state by a pilot signal pressure that is applied thereto when a first actuator generating a high-load operating pressure and a second actuator generating a low-load operating pressure in accordance with a driving direction are simultaneously manipulated, and to be shifted to a throttle release state by a pilot signal pressure that is applied thereto when the first actuator generating a high-load operating pressure and the second actuator generating a high-load operating pressure in accordance with the driving direction are simultaneously manipulated and an elastic force of a valve spring.

In accordance with a second embodiment of the present invention, there is provided a priority control system for a construction machine, including:

an engine;

first and second variable displacement hydraulic pumps connected to the engine and a pilot pump;

a boom control valve configured to control the drive of a boom cylinder, a bucket control valve configured to control the drive of a bucket cylinder, and a traveling control valve configured to control the drive of a left traveling motor, wherein the boom control valve, the bucket control valve, and the traveling control valve are installed in a first center bypass path of the first hydraulic pump so as to be connected to each other through a parallel flow path;

a swing control valve configured to control the drive of a swing motor, an arm control valve configured to control the drive of an arm cylinder, and a traveling control valve configured to control the drive of a right traveling motor, wherein the swing control valve, the arm control value, and the traveling control valve are installed in a second center bypass path of the second hydraulic pump so as to be connected to each other through a parallel flow path;

first and second pressure generation devices configured to output a control signal corresponding to a manipulation amount, respectively;

a shuttle valve configured to output any one selected from pilot signal pressures applied to the swing control valve so that the swing motor can be swung in a left or right direction in response to the manipulation of the first pressure generation device;

a priority control valve installed in a flow path between the parallel flow path on the second hydraulic pump side and an inlet port of the arm control valve, and configured to be switched to a throttle state by a pilot signal pressure that is applied thereto when a first actuator generating a high-load operating pressure and a second actuator generating a low-load operating pressure in accordance with a driving direction are simultaneously manipulated, and to be shifted to a throttle release state by a pilot signal pressure that is applied thereto when the first actuator generating a high-load operating pressure and the second actuator generating a high-load operating pressure in accordance with the driving direction are simultaneously manipulated; and a signal line shutoff valve installed in a flow path between the shuttle valve and the priority control valve and configured to shut off the flow path only by a pilot signal pressure that is applied to the arm control valve to perform an arm-out driving operation in response to the manipulation of the second pressure generation device.

In accordance with a third embodiment of the present invention, there is provided a priority control system for a construction machine, including:

an engine;

first and second variable displacement hydraulic pumps connected to the engine and a pilot pump;

a boom control valve configured to control the drive of a boom cylinder, a bucket control valve configured to control the drive of a bucket cylinder, and a traveling control valve configured to control the drive of a left traveling motor, wherein the boom control valve, the bucket control valve, and the traveling control valve are installed in a first center bypass path of the first hydraulic pump so as to be connected to each other through a parallel flow path;

a swing control valve configured to control the drive of a swing motor, an arm control valve configured to control the drive of an arm cylinder, and a traveling control valve configured to control the drive of a right traveling motor, wherein the swing control valve, the arm control value, and the traveling control valve are installed in a second center bypass path of the second hydraulic pump so as to be connected to each other through a parallel flow path;

first and second pressure generation devices configured to output a control signal corresponding to a manipulation amount, respectively;

a shuttle valve configured to output any one selected from pilot signal pressures applied to the swing control valve so that the swing motor can be swung in a left or right direction in response to the manipulation of the first pressure generation device;

a priority control valve installed in a flow path between the parallel flow path on the second hydraulic pump side and an inlet port of the arm control valve, and configured to be switched to a throttle state by a pilot signal pressure that is applied thereto when a first actuator generating a high-load operating pressure and a second actuator generating a low-load operating pressure in accordance with a driving direction are simultaneously manipulated, and to be shifted to a throttle release state by a pilot signal pressure that is applied thereto when the first actuator generating a high-load operating pressure and the second actuator generating a high-load operating pressure in accordance with the driving direction are simultaneously manipulated;

a signal line shutoff valve installed in a flow path between the shuttle valve and the priority control valve and configured shifted to shut off the flow path in response to an external electric control signal;

a first pressure detection means configured to detect the pilot signal pressure that is applied to the arm control valve and output a detection signal to perform an arm-out driving operation in response to the manipulation of the second pressure generation device; and a controller configured to output an electric control signal to the signal line shutoff valve to shift the signal line shutoff valve when the pilot signal pressure for performing an arm-out driving operation reaches a set value in response to the detection signal applied thereto from the first pressure detection means.

In accordance with a fourth embodiment of the present invention, there is provided a priority control system for a construction machine, including:

an engine;

first and second variable displacement hydraulic pumps connected to the engine and a pilot pump;

a boom control valve configured to control the drive of a boom cylinder, a bucket control valve configured to control the drive of a bucket cylinder, and a traveling control valve configured to control the drive of a left traveling motor, wherein the boom control valve, the bucket control valve, and the traveling control valve are installed in a first center bypass path of the first hydraulic pump so as to be connected to each other through a parallel flow path;

a swing control valve configured to control the drive of a swing motor, an arm control valve configured to control the drive of an arm cylinder, and a traveling control valve configured to control the drive of a right traveling motor, wherein the swing control valve, the arm control value, and the traveling control valve are installed in a second center bypass path of the second hydraulic pump so as to be connected to each other through a parallel flow path;

first and second pressure generation devices configured to output a control signal corresponding to a manipulation amount, respectively;

a shuttle valve configured to output any one selected from pilot signal pressures applied to the swing control valve so that the swing motor can be swung in a left or right direction in response to the manipulation of the first pressure generation device;

a priority control valve installed in a flow path between the parallel flow path on the second hydraulic pump side and an inlet port of the arm control valve, and configured to be switched to a throttle state by a pilot signal pressure that is applied thereto when a first actuator generating a high-load operating pressure and a second actuator generating a low-load operating pressure in accordance with a driving direction are simultaneously manipulated, and to be shifted to a throttle release state by a pilot signal pressure that is applied thereto when the first actuator generating a high-load operating pressure and the second actuator generating a high-load operating pressure in accordance with the driving direction are simultaneously manipulated;

a pressure reduction valve installed in a flow path between the pilot pump 4 and the priority control valve;

a first pressure detection means configured to detect the pilot signal pressure that is applied to the arm control valve and output a detection signal to perform an arm-out driving operation in response to the manipulation of the second pressure generation device;

a second pressure detection means configured to detect a pilot signal pressure that is outputted from the shuttle valve which outputs any one selected from pilot signal pressures applied to the swing control valve, and output a detection signal so that the swing motor is driven in a left or right direction in response to the manipulation of the first pressure generation device; and a controller configured to output a control signal to the pressure reduction valve to increase a secondary signal pressure that is outputted from the pressure reduction valve when a swing pilot signal pressure is increased by the detection signal applied thereto from the second pressure detection means, and to reduce the secondary signal pressure that is outputted from the pressure reduction valve when the pilot signal pressure for performing the arm-out driving operation is applied to the arm control valve 16 by the detection signal applied thereto from the first pressure detection means.

In accordance with a preferred embodiment of the present invention, the priority control valve is shifted to the throttle state by the pilot signal pressure that is outputted from the shuttle valve when the swing operation and the arm-in driving operation are simultaneously performed, and is shifted to the throttle release state by the elastic force of the valve spring of the priority control valve and the pilot signal pressure that is applied to the arm control valve to perform the arm-out driving operation when the swing operation and the arm-out driving operation are simultaneously performed.

The first actuator is the swing motor, and the second actuator is the arm cylinder.

A solenoid valve that is shifted in response to the electric control signal applied thereto from the controller is used as the signal line shutoff valve.

A pressure sensor that detects the pilot signal pressure applied to the arm control valve and transmits the detection signal to the controller is used as the first pressure detection means.

A pressure switch, which is turned on/off to generate a signal when the pilot signal pressure applied to the arm control valve reaches the set pressure, is used as the first pressure detection means.

An electro proportional control valve for varying the secondary signal pressure outputted therefrom in response to the electric control signal value applied thereto is used as the pressure reduction valve.

Pressure sensors for detecting the pilot signal pressure applied to the arm control valve and outputting the detection signal for application to the controller are used as the first and second pressure detection means.

Pressure switches, which are turned on/off to generate a signal when the pilot signal pressure applied to the arm control valve reaches the set pressure, are used as the first and second pressure detection means.

Advantageous Effect

The priority control system for a construction machine in accordance with an embodiment of the present invention as constructed above has the following advantages.

When a swing apparatus generating a high operating pressure and an arm generating a high or low operating pressure depending on the driving direction are simultaneously manipulated, the priority control valve is shifted to a throttle state or a throttle release state to maintain simultaneous manipulability or prevent an unnecessary pressure loss and secure the operating speed of the hydraulic actuator depending on the amount of a load occurring in the hydraulic actuator so that workability is improved and the distribution of the hydraulic fluid can be controlled optimally, thereby enhancing the efficiency of the hydraulic system.

BRIEF DESCRIPTION OF THE DRAWINGS

The above objects, other features and advantages of the present invention will become more apparent by describing the preferred embodiments thereof with reference to the accompanying drawings, in which.

EXPLANATION ON REFERENCE NUMERALS OF MAIN ELEMENTS IN THE DRAWINGS

Figure 1:
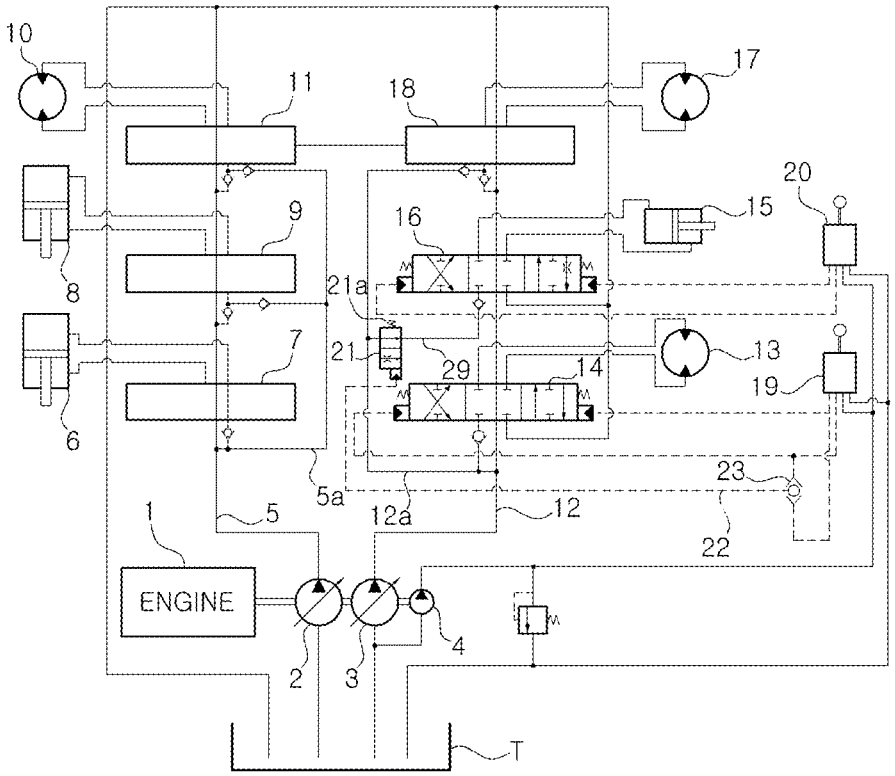
FIG. 1 is a hydraulic circuit diagram showing a priority control system for a construction machine in accordance with the prior art.

1: engine
2: variable displacement first hydraulic pump
3: variable displacement second hydraulic pump
4: pilot pump
5: first center bypass path
6: boom cylinder
7: boom control valve
8: bucket cylinder
9: bucket control valve
10, 17: traveling motor
11, 18: traveling control valve
12: second center bypass path
13: swing motor
14: swing control valve
15: arm cylinder
16: arm control valve
19: first pressure generation device
20: second pressure generation device
21: priority control valve
22, 29, 30: flow path
23: shuttle valve
24: signal line shutoff valve
25: pressure reduction valve
26: first pressure detection means
27: controller
28: second pressure detection means

Preferred Embodiments of the Invention

Hereinafter, preferred embodiments of the present invention will be described in detail with reference to the accompanying drawings.

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 2:
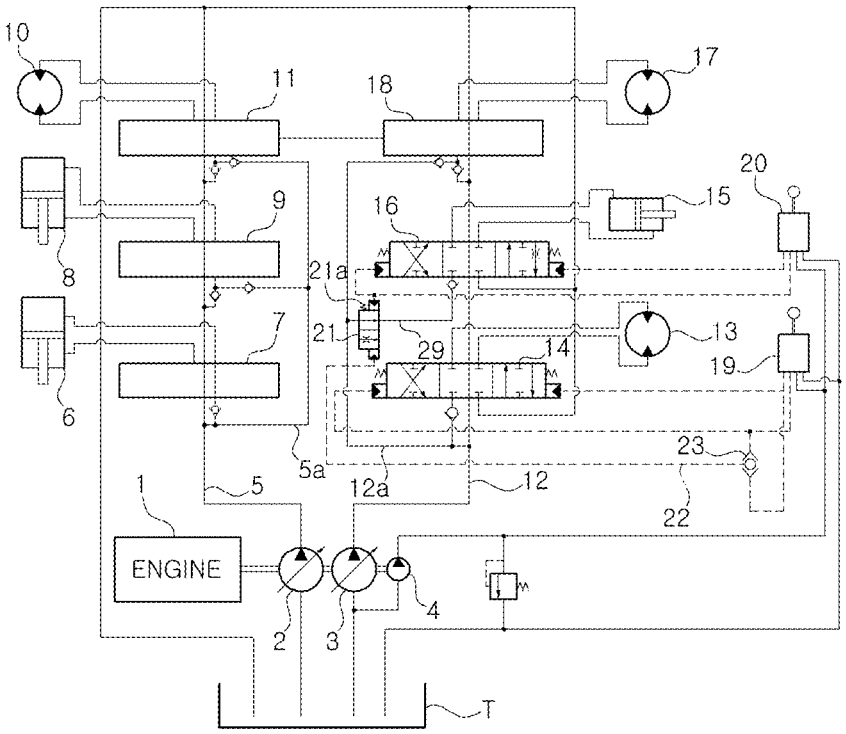
FIG. 2 is a hydraulic circuit diagram showing a priority control system for a construction machine in accordance with a first embodiment of the present invention.

A priority control system for a construction machine in accordance with a first embodiment of the present invention as shown in FIG. 2 includes:

an engine 1;

first and second variable displacement hydraulic pumps (hereinafter, referred to as "first and second hydraulic pumps") 2 and 3 that are connected to the engine 1 and a pilot pump 4;

a boom control valve 7 that controls the drive of a boom cylinder 6, a bucket control valve 9 that controls the drive of a bucket cylinder 8, and a traveling control valve 11 that controls the drive of a left traveling motor 10, wherein the boom control valve, the bucket control valve, and the traveling control valve are installed in a first center bypass path 5 of the first hydraulic pump 2 so as to be connected to each other through a parallel flow path 5*a;* a swing control valve 14 that controls the drive of a swing motor 13, an arm control valve 16 that controls the drive of an arm cylinder 15, and a traveling control valve 18 controls the drive of a right traveling motor 17, wherein the swing control valve, the arm control value, and the traveling control valve are installed in a second center bypass path 12 of the second hydraulic pump 3 so as to be connected to each other through a parallel flow path 12*a;* first and second pressure generation devices 19 and 20 that outputs a control signal corresponding to a manipulation amount, respectively;

a shuttle valve 23 that outputs any one selected from pilot signal pressures applied to the swing control valve 14 so that the swing motor 13 can be swung in a left or right direction in response to the manipulation of the first pressure generation device 19; and a priority control valve 21 that is installed in a flow path 29 between the parallel flow path 12*a* on the second hydraulic pump 3 side and an inlet port of the arm control valve 16, and is switched to a throttle state by a pilot signal pressure that is applied thereto when a first actuator (e.g., swing motor) generating a high-load operating pressure and a second actuator (e.g., arm cylinder) generating a low-load operating pressure in accordance with a driving direction (e.g., arm-in driving direction) are simultaneously manipulated, and is shifted to a throttle release state by a pilot signal pressure that is applied thereto when the first actuator generating a high-load operating pressure and the second actuator generating a high-load operating pressure in accordance with the driving direction (e.g., arm-out driving direction) are simultaneously manipulated and an elastic force of a valve spring 21*a*.

In this case, the priority control valve 21 is shifted to the throttle state by the pilot signal pressure that is outputted from the shuttle valve 23 when a swing operation and an arm-in driving operation are simultaneously performed, and is shifted to the throttle release state by the elastic force of the valve spring 21*a* of the priority control valve 21 and the pilot signal pressure that is applied to the arm control valve 16 to perform an arm-out driving operation when the swing operation and the arm-out driving operation are simultaneously performed.

In this case, the configuration of the priority control system in accordance with the first embodiment of the present invention as shown in FIG. 2 is the same as that of the conventional priority control system as shown in FIG. 1, except the priority control valve 21 that is installed in a flow path 29 between the parallel flow path 12*a* on the second hydraulic pump 3 side and an inlet port of the arm control valve 16, and is shifted to the throttle state to restrict the supply of a hydraulic fluid to the arm control valve 16 from the second hydraulic pump 3 when the swing operation and the arm-in driving operation are simultaneously, and is shifted to the throttle release state to control the supply of the hydraulic fluid to the arm control valve 16 from the second hydraulic pump 3 in response to the manipulation amount of the second pressure generation device 20 when the swing operation and the arm-out driving operation are simultaneously. Thus, the detailed description of the same configuration and operation thereof will be omitted to avoid redundancy, and the same elements are denoted by the same reference numerals.

Hereinafter, a use example of the priority control system for a construction machine in accordance with a first embodiment of the present invention will be described in detail with reference to the accompanying drawings.

When the first and second pressure generation devices 19 and 20 are simultaneously manipulated to simultaneously perform the swing operation and the arm-in driving operation of the excavator, a pilot signal pressure outputted from the shuttle valve 23 is supplied to a pressure chamber of the priority control valve 21 along a flow path 22 to cause an internal spool of the priority control valve 21 to be shifted to the top on the drawing sheet to switch the priority control valve 21 to the throttle state so that the swing motor 13 can be driven in a left or right direction in response to the manipulation of the first pressure generation device 19.

Thus, the swing control valve 14 is shifted to rotate the swing motor 13 in the left or right direction through the manipulation of the first pressure generation device 19, so that the hydraulic fluid discharged from the second hydraulic pump 3 is supplied to the swing motor 13 via the swing control valve 14 along the second center bypass path 12 to cause the swing motor to be driven.

At the same time, the arm control valve 16 is shifted to the left on the drawing sheet to perform the arm-in driving operation through the manipulation of the second pressure generation device 20, so that the hydraulic fluid discharged from the second hydraulic pump 3 is supplied to a large chamber of the arm cylinder 15 via the following paths to cause the arm cylinder to be driven in a stretchable manner: the second center bypass path 12→the parallel flow path 12*a*→the priority control valve 21 of the throttle state→the flow path 29→the arm control valve 16.

In the meantime, since a load value occurring during the swing operation of the upper swing structure relative to the lower traveling structure of the excavator is larger than that occurring during the arm-in driving operation, a flow rate of the hydraulic fluid discharged from the second hydraulic pump 3 supplied to the arm control valve 16 is higher than a flow rate as supplied to the swing control valve 14.

At this time, since the internal spool of the priority control valve 21 is in a state of being shifted to the throttle state, an inlet of the flow path 29 branched off from the parallel flow path 12*a* and connected to the inlet port of the arm control valve 16 is reduced to restrict the supply of the hydraulic fluid to the arm control valve 16 from the second hydraulic pump 3.

Therefore, when the swing operation and the arm-in driving operation are simultaneously performed, the spool of the priority control valve 21 is shifted to the throttle state so that the flow rate of the hydraulic fluid supplied to the arm control valve 16 is restricted and thus simultaneous workability can be maintained.

Meanwhile, in the case the swing operation and the arm-out driving operation of the excavator are simultaneously performed by simultaneously manipulating the first and second pressure generation devices 19 and 20, since a high load occurs during the swing operation and the arm-out driving operation, the priority control valve 21 is maintained in an initial state in which its throttle state is released (see FIG. 2).

Therefore, the swing motor 13 is swung in a left or right direction through the manipulation of the first pressure generation device 19, so that the hydraulic fluid discharged from the second hydraulic pump 3 is supplied to the swing motor 13 via the swing control valve 14 along the second center bypass path 12 to cause the swing motor to be driven.

At the same time, the pilot signal pressure is supplied to the pressure chamber of the arm control valve 16 due to the manipulation of the second pressure generation device 20 to cause an internal spool of the arm control valve 16 to be shifted to the right on the drawing sheet. In addition, apart of the pilot signal pressure supplied to the arm control valve 16 is applied to the valve spring 21*a* so that the priority control valve 21 is maintained in the throttle state. That is, a value obtained by adding the elastic force of the valve spring 21*a* of the priority control valve 21 and the pilot signal pressure applied to the arm control valve 16 during the arm-out driving operation is larger than a value of the pilot signal pressure applied to the pressure chamber of the priority control valve 21.

Thus, a part of the hydraulic fluid discharged from the second hydraulic pump 3 is supplied to the swing motor 13 via the swing control valve 14 along the second center bypass path 12 to cause the swing motor to be driven. At the same time, a part of the hydraulic fluid discharged from the second hydraulic pump 3 is supplied to a small chamber of the arm cylinder 15 via the following paths to cause the arm cylinder to be driven in a retractable manner: the second center bypass path 12→the parallel flow path 12*a*→the priority control valve 21 of the throttle release state→the flow path 29→the arm control valve 16.

As described above, according to the priority control system in accordance with the first embodiment of the present invention, when the swing operation and the arm-out driving operation are simultaneously performed, the spool of the priority control valve 21 is shifted to the throttle release state to maximally switch the flow path of the throttle device, thereby preventing an unnecessary pressure loss.

Figure 3:
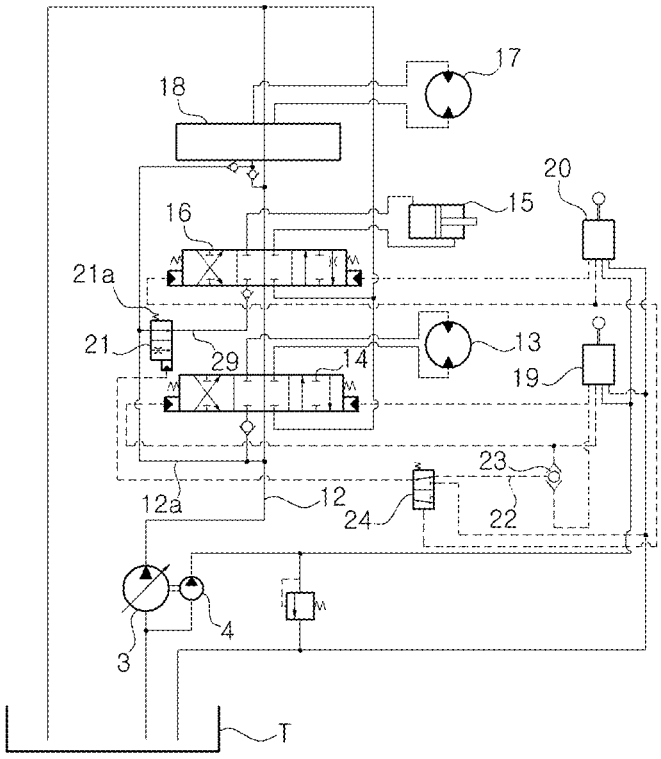
FIG. 3 is a hydraulic circuit diagram showing a priority control system for a construction machine in accordance with a second embodiment of the present invention.

A priority control system for a construction machine in accordance with a second embodiment of the present invention as shown in FIG. 3 includes:

an engine 1;

first and second variable displacement hydraulic pumps 2 and 3 connected to the engine 1 and a pilot pump 4;

a boom control valve 7 that controls the drive of a boom cylinder 6, a bucket control valve 9 that controls the drive of a bucket cylinder 8, and a traveling control valve 11 that controls the drive of a left traveling motor 10, wherein the boom control valve, the bucket control valve, and the traveling control valve are installed in a first center bypass path 5 of the first hydraulic pump 2 so as to be connected to each other through a parallel flow path 5*a;* a swing control valve 14 that controls the drive of a swing motor 13, an arm control valve 16 that controls the drive of an arm cylinder 15, and a traveling control valve 18 that controls the drive of a right traveling motor 17, wherein the swing control valve, the arm control value, and the traveling control valve are installed in a second center bypass path 12 of the second hydraulic pump 3 so as to be connected to each other through a parallel flow path 12*a;* first and second pressure generation devices 19 and 20 that outputs a control signal corresponding to a manipulation amount, respectively;

a shuttle valve 23 that outputs any one selected from pilot signal pressures applied to the swing control valve 14 so that the swing motor 13 can be swung in a left or right direction in response to the manipulation of the first pressure generation device 19;

a priority control valve 21 that is installed in a flow path 29 between the parallel flow path 12*a* on the second hydraulic pump 3 side and an inlet port of the arm control valve 16, and is shifted to a throttle state by a pilot signal pressure that is applied thereto when a first actuator generating a high-load operating pressure and a second actuator generating a low-load operating pressure in accordance with a driving direction are simultaneously manipulated, and is shifted to a throttle release state by a pilot signal pressure that is applied thereto when the first actuator generating a high-load operating pressure and the second actuator generating a high-load operating pressure in accordance with the driving direction are simultaneously; and a signal line shutoff valve 24 that is installed in a flow path 22 between the shuttle valve 23 and the priority control valve 21 and shuts off the flow path 22 only by a pilot signal pressure that is applied to the arm control valve 16 to perform an arm-out driving operation in response to the manipulation of the second pressure generation device 20.

In this case, the configuration of the boom control valve 7 that controls the drive of the boom cylinder 6, the bucket control valve 9 that controls the drive of the bucket cylinder 8, and the traveling control valve 11 that controls the drive of the left traveling motor 10, wherein the boom control valve, the bucket control valve, and the traveling control valve are installed in a first center bypass path 5 of the first hydraulic pump 2 so as to be connected to each other through a parallel flow path 5*a* is the same as that of the corresponding elements as shown in FIG. 2, and thus redundant illustration of the same configuration thereof is avoided in the accompanying drawings.

In the meantime, the configuration of the priority control system in accordance with the second embodiment of the present invention as shown in FIG. 3 is the same as that of the priority control system as shown in FIG. 2, except the signal line shutoff valve 24 that is installed in a flow path 22 between the shuttle valve 23 and the priority control valve 21 and shuts off the flow path 22 only by a pilot signal pressure that is applied to the arm control valve 16 to perform an arm-out driving operation. Thus, the detailed description of the same configuration and operation thereof will be omitted to avoid redundancy, and the same elements are denoted by the same reference numerals.

Therefore, in the case the swing operation and the arm-out driving operation of the excavator are simultaneously performed by simultaneously manipulating the first and second pressure generation devices 19 and 20, since a high load occurs during the swing operation and the arm-out driving operation, the priority control valve 21 is maintained in an initial state in which its throttle state is released (see FIG. 3).

The pilot signal pressure is supplied to the pressure chamber of the arm control valve 16 due to the manipulation of the second pressure generation device 20 to cause an internal spool of the arm control valve 16 to be shifted to the right on the drawing sheet. At the same time, a part of the pilot signal pressure supplied to the arm control valve 16 is applied to the signal line shutoff valve 24 to cause an internal spool of the signal line shutoff valve 24 to be shifted to the top on the drawing sheet. For this reason, the supply of the pilot signal pressure to the pressure chamber of the priority control valve 21 is interrupted during the manipulation of the first pressure generation device 19, so that the priority control valve 21 is maintained in an initial state in which its throttle state is released by the elastic force of the valve spring 21*a*.

Thus, a part of the hydraulic fluid discharged from the second hydraulic pump 3 is supplied to the swing motor 13 via the swing control valve 14 along the second center bypass path 12 to cause the swing motor to be driven. At the same time, a part of the hydraulic fluid discharged from the second hydraulic pump 3 is supplied to a small chamber of the arm cylinder 15 via the following paths to cause the arm cylinder to be driven in a retractable manner: the second center bypass path 12→the parallel flow path 12*a*→the priority control valve 21 of the throttle release state→the flow path 29→the arm control valve 16.

As described above, according to the priority control system in accordance with the second embodiment of the present invention, when the swing operation and the arm-out driving operation are simultaneously performed, the spool of the priority control valve 21 is shifted to the throttle release state by the signal line shutoff valve 24 to maximally switch the flow path of the throttle device, thereby preventing an unnecessary pressure loss.

In this case, the configuration of the boom control valve 7 that controls the drive of the boom cylinder 6, the bucket control valve 9 that controls the drive of the bucket cylinder 8, and the traveling control valve 11 that controls the drive of the left traveling motor 10, wherein the boom control valve, the bucket control valve, and the traveling control valve are installed in a first center bypass path 5 of the first hydraulic pump 2 so as to be connected to each other through a parallel flow path 5*a* is the same as that of the corresponding elements as shown in FIG. 2, and thus redundant illustration of the same configuration thereof is avoided in the accompanying drawings.

A priority control system for a construction machine in accordance with a third embodiment of the present invention as shown in FIG. 3 includes:

an engine 1;

first and second variable displacement hydraulic pumps 2 and 3 connected to the engine 1 and a pilot pump 4;

a boom control valve 7 that controls the drive of a boom cylinder 6, a bucket control valve 9 that controls the drive of a bucket cylinder 8, and a traveling control valve 11 that controls the drive of a left traveling motor 10, wherein the boom control valve, the bucket control valve, and the traveling control valve are installed in a first center bypass path 5 of the first hydraulic pump 2 so as to be connected to each other through a parallel flow path 5*a;* a swing control valve 14 that controls the drive of a swing motor 13, an arm control valve 16 that controls the drive of an arm cylinder 15, and a traveling control valve 18 that controls the drive of a right traveling motor 17, wherein the swing control valve, the arm control value, and the traveling control valve are installed in a second center bypass path 12 of the second hydraulic pump 3 so as to be connected to each other through a parallel flow path 12*a;* first and second pressure generation devices 19 and 20 that outputs a control signal corresponding to a manipulation amount, respectively;

a shuttle valve 23 that outputs any one selected from pilot signal pressures applied to the swing control valve 14 so that the swing motor 13 can be swung in a left or right direction in response to the manipulation of the first pressure generation device 19;

a priority control valve 21 that is installed in a flow path 29 between the parallel flow path 12*a* on the second hydraulic pump 3 side and an inlet port of the arm control valve 16, and is shifted to a throttle state by a pilot signal pressure that is applied thereto when a first actuator generating a high-load operating pressure and a second actuator generating a low-load operating pressure in accordance with a driving direction are simultaneously manipulated, and is shifted to a throttle release state by a pilot signal pressure that is applied thereto when the first actuator generating a high-load operating pressure and the second actuator generating a high-load operating pressure in accordance with the driving direction are simultaneously;

a signal line shutoff valve 24 that is installed in a flow path 22 between the shuttle valve 23 and the priority control valve 21 and shuts off the flow path 22 only by a pilot signal pressure that is applied to the arm control valve 16 to perform an arm-out driving operation in response to the manipulation of the second pressure generation device 20;

a signal line shutoff valve 24 that is installed in a flow path 22 between the shuttle valve 23 and the priority control valve 21 and is shifted to shut off the flow path 22 in response to an external electric control signal;

a first pressure detection means 26 that detects the pilot signal pressure that is applied to the arm control valve 16 and outputs a detection signal to perform an arm-out driving operation in response to the manipulation of the second pressure generation device 20; and a controller 27 that outputs an electric control signal to the signal line shutoff valve 24 to shift the signal line shutoff valve when the pilot signal pressure for performing the arm-out driving operation reaches a set value in response to the detection signal applied thereto from the first pressure detection means 26.

A solenoid valve that is shifted in response to the electric control signal applied thereto from the controller 27 is used as the signal line shutoff valve 24.

A pressure sensor that detects the pilot signal pressure applied to the arm control valve 16 and transmits the detection signal to the controller 27 is used as the first pressure detection means 26.

A pressure switch, which is turned on/off to generate a signal when the pilot signal pressure applied to the arm control valve 16 reaches the set pressure, is used as the first pressure detection means 26.

In this case, the configuration of the boom control valve 7 that controls the drive of the boom cylinder 6, the bucket control valve 9 that controls the drive of the bucket cylinder 8, and the traveling control valve 11 that controls the drive of the left traveling motor 10, wherein the boom control valve, the bucket control valve, and the traveling control valve are installed in a first center bypass path 5 of the first hydraulic pump 2 so as to be connected to each other through a parallel flow path 5*a* is the same as that of the corresponding elements as shown in FIG. 2, and thus redundant illustration of the same configuration thereof is avoided in the accompanying drawings.

Figure 4:
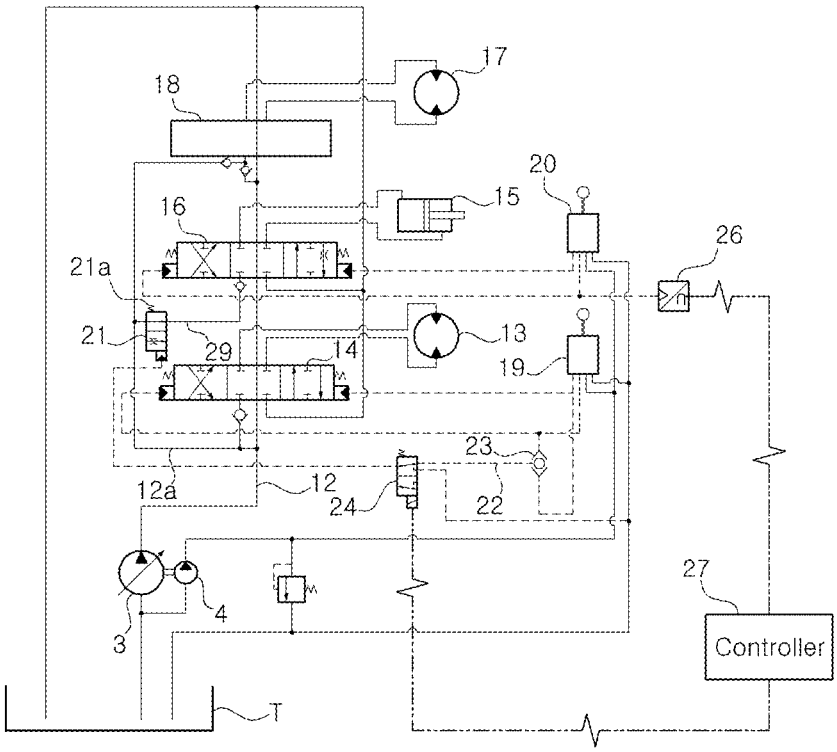
FIG. 4 is a hydraulic circuit diagram showing a priority control system for a construction machine in accordance with a third embodiment of the present invention.

In the meantime, the configuration of the priority control system in accordance with the third embodiment of the present invention as shown in FIG. 4 is the same as that of the first priority control system as shown in FIG. 2, except the signal line shutoff valve 24 that is installed in a flow path 22 between the shuttle valve 23 and the priority control valve 21 and is shifted to shut off the flow path 22 in response to an external electric control signal, the first pressure detection means 26 that detects the pilot signal pressure that is applied to the arm control valve 16 and outputs a detection signal to perform the arm-out driving operation, and the controller 27 that outputs an electric control signal to the signal line shutoff valve 24 to shift the signal line shutoff valve when the pilot signal pressure for performing the arm-out driving operation reaches the set value. Thus, the detailed description of the same configuration and operation thereof will be omitted to avoid redundancy, and the same elements are denoted by the same reference numerals.

Thus, in the case the swing operation and the arm-out driving operation of the excavator are simultaneously performed by simultaneously manipulating the first and second pressure generation devices 19 and 20, the pilot signal pressure is supplied to the pressure chamber of the arm control valve 16 due to the manipulation of the second pressure generation device 20 to cause an internal spool of the arm control valve 16 to be shifted to the right on the drawing sheet. At this time, the pressure detection means 26 detects the pilot signal pressure that is applied to the arm control valve 16 to perform the arm-out driving operation, and outputs a detection signal for application to the controller 27. If it is determined that the pilot signal pressure for performing the arm-out driving operation reaches the set value, the controller 27 applies an electric control signal to the signal line shutoff valve 24 to shift an internal spool of the signal line shutoff valve to the top on the drawing sheet to shut off the flow path 22 along which the pilot signal pressure is supplied to the pressure chamber of the priority control valve 21. Thus, the priority control valve 21 can be maintained in an initial state in which its throttle state is released by the elastic force of the valve spring 21*a* (see FIG. 4).

Thus, a part of the hydraulic fluid discharged from the second hydraulic pump 3 is supplied to the swing motor 13 via the swing control valve 14 along the second center bypass path 12 to cause the swing motor to be driven. At the same time, a part of the hydraulic fluid discharged from the second hydraulic pump 3 is supplied to a small chamber of the arm cylinder 15 via the following paths: the second center bypass path 12→the parallel flow path 12*a*→the priority control valve 21 of the throttle release state→the flow path 29→the arm control valve 16.

As described above, according to the priority control system in accordance with the third embodiment of the present invention, when the swing operation and the arm-out driving operation are simultaneously performed, the spool of the priority control valve 21 is shifted to the throttle release state by the signal line shutoff valve 24 to maximally switch the flow path of the throttle device, thereby preventing an unnecessary pressure loss.

Figure 5:
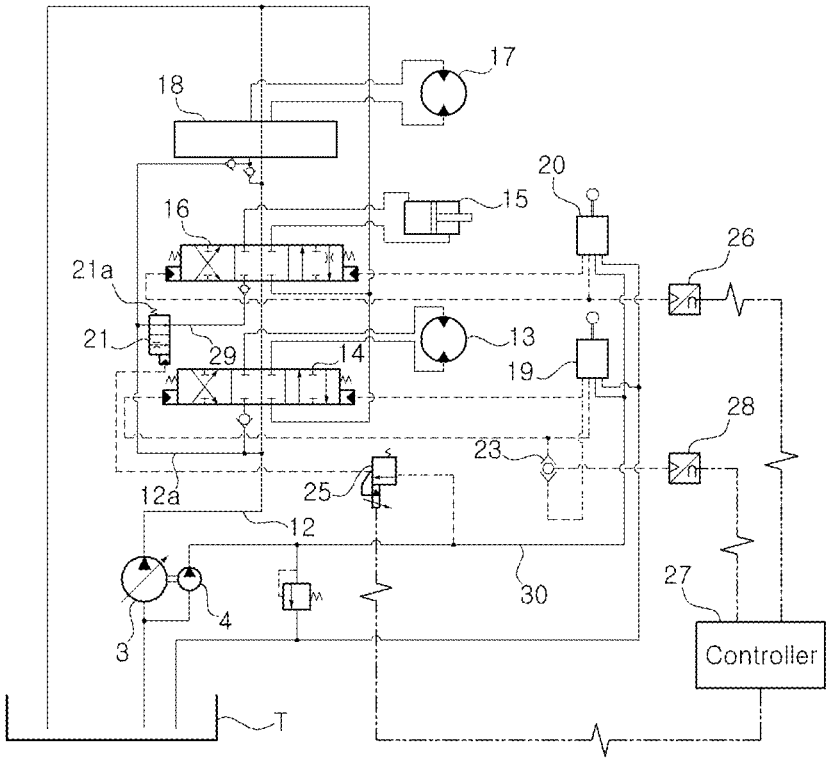
FIG. 5 is a hydraulic circuit diagram showing a priority control system for a construction machine in accordance with a fourth embodiment of the present invention.

A priority control system for a construction machine in accordance with a fourth embodiment of the present invention as shown in FIG. 5 includes:

an engine 1;

first and second variable displacement hydraulic pumps 2 and 3 connected to the engine 1 and a pilot pump 4;

a boom control valve 7 that controls the drive of a boom cylinder 6, a bucket control valve 9 that controls the drive of a bucket cylinder 8, and a traveling control valve 11 that controls the drive of a left traveling motor 10, wherein the boom control valve, the bucket control valve, and the traveling control valve are installed in a first center bypass path 5 of the first hydraulic pump 2 so as to be connected to each other through a parallel flow path 5*a;* a swing control valve 14 that controls the drive of a swing motor 13, an arm control valve 16 that controls the drive of an arm cylinder 15, and a traveling control valve 18 that controls the drive of a right traveling motor 17, wherein the swing control valve, the arm control value, and the traveling control valve are installed in a second center bypass path 12 of the second hydraulic pump 3 so as to be connected to each other through a parallel flow path 12*a;* first and second pressure generation devices 19 and 20 that outputs a control signal corresponding to a manipulation amount, respectively;

a shuttle valve 23 that outputs any one selected from pilot signal pressures applied to the swing control valve 14 so that the swing motor 13 can be swung in a left or right direction in response to the manipulation of the first pressure generation device 19;

a priority control valve 21 that is installed in a flow path 29 between the parallel flow path 12*a* on the second hydraulic pump 3 side and an inlet port of the arm control valve 16, and is shifted to a throttle state by a pilot signal pressure that is applied thereto when a first actuator generating a high-load operating pressure and a second actuator generating a low-load operating pressure in accordance with a driving direction are simultaneously manipulated, and is shifted to a throttle release state by a pilot signal pressure that is applied thereto when the first actuator generating a high-load operating pressure and the second actuator generating a high-load operating pressure in accordance with the driving direction are simultaneously;

a pressure reduction valve 25 that is installed in a flow path 30 between the pilot pump 4 and the priority control valve 21;

a first pressure detection means 26 that detects pilot signal pressure that is applied to the arm control valve 16 and outputs a detection signal to perform an arm-out driving operation in response to the manipulation of the second pressure generation device 20;

a second pressure detection means 28 that detects a pilot signal pressure that is outputted from the shuttle valve 23 which outputs any one selected from pilot signal pressures applied to the swing control valve 14, and outputs a detection signal so that the swing motor 13 is driven in a left or right direction in response to the manipulation of the first pressure generation device 19; and a controller 27 that outputs a control signal to the pressure reduction valve 25 to increase a secondary signal pressure that is outputted from the pressure reduction valve 25 when a swing pilot signal pressure is increased by the detection signal applied thereto from the second pressure detection means 28, and to reduce the secondary signal pressure that is outputted from the pressure reduction valve 25 when the pilot signal pressure for performing the arm-out driving operation is applied to the arm control valve 16 by the detection signal applied thereto from the first pressure detection means 26.

An electro proportional control valve for varying the secondary signal pressure outputted therefrom in response to the electric control signal value applied thereto is used as the pressure reduction valve 25.

Pressure sensors for detecting the pilot signal pressure applied to the arm control valve 16 and outputting the detection signal for application to the controller 27 are used as the first and second pressure detection means 26 and 28.

Pressure switches, which are turned on/off to generate a signal when the pilot signal pressure applied to the arm control valve 16 reaches the set pressure, are used as the first and second pressure detection means 26 and 28.

In this case, the configuration of the boom control valve 7 that controls the drive of the boom cylinder 6, the bucket control valve 9 that controls the drive of the bucket cylinder 8, and the traveling control valve 11 that controls the drive of the left traveling motor 10, wherein the boom control valve, the bucket control valve, and the traveling control valve are installed in a first center bypass path 5 of the first hydraulic pump 2 so as to be connected to each other through a parallel flow path 5*a* is the same as that of the corresponding elements as shown in FIG. 2, and thus redundant illustration of the same configuration thereof is avoided in the accompanying drawings.

In the meantime, the configuration of the priority control system in accordance with the fourth embodiment of the present invention as shown in FIG. 5 is the same as that of the priority control system as shown in FIG. 2, except the pressure reduction valve 25 that is installed in a flow path 30 between the pilot pump 4 and the priority control valve 21, the first pressure detection means 26 that detects pilot signal pressure that is applied to the arm control valve 16 to perform an arm-out driving operation, the second pressure detection means 28 that detects a pilot signal pressure that is outputted from the shuttle valve 23 which outputs any one selected from pilot signal pressures applied to the swing control valve 14, and the controller 27 that outputs a control signal to the pressure reduction valve 25 to increase a secondary signal pressure that is outputted from the pressure reduction valve 25 when a swing pilot signal pressure is increased, and to reduce the secondary signal pressure that is outputted from the pressure reduction valve 25 when the pilot signal pressure for performing the arm-out driving operation is applied thereto. Thus, the detailed description of the same configuration and operation thereof will be omitted to avoid redundancy, and the same elements are denoted by the same reference numerals.

Thus, in the case the swing operation and the arm-out driving operation of the excavator are simultaneously performed by simultaneously manipulating the first and second pressure generation devices 19 and 20, the pilot signal pressure is supplied to the pressure chamber of the arm control valve 16 due to the manipulation of the second pressure generation device 20 to cause an internal spool of the arm control valve 16 to be shifted to the right on the drawing sheet. At this time, the pressure detection means 26 detects the pilot signal pressure that is applied to the arm control valve 16 to perform the arm-out driving operation, and outputs a detection signal for application to the controller 27.

In addition, the pilot signal pressure is applied to the swing control valve 14 so that the swing motor 13 can be driven in a left or right direction in response to the manipulation of the first pressure generation device 19. At this time, the second pressure detection means 28 detects the pilot signal pressure outputted from the shuttle valve 23 and outputs a detection signal for application to the controller 27.

The controller 27 outputs a control signal to the pressure reduction valve 25 to increase a secondary signal pressure that is outputted from the pressure reduction valve 25 when a swing pilot signal pressure is increased by the detection signal applied thereto from the second pressure detection means 28. Further, the controller 27 outputs a control signal to the pressure reduction valve 25 to reduce the secondary signal pressure that is outputted from the pressure reduction valve 25 when the pilot signal pressure for performing the arm-out driving operation is applied to the arm control valve 16 by the detection signal applied thereto from the first pressure detection means 26.

Thus, when the swing pilot signal pressure is increased, the controller 27 controls the secondary signal pressure outputted from the pressure reduction valve 25 to be increased so that the priority control valve 21 is shifted to a throttle state to restrict the supply of the hydraulic fluid to the arm control valve 16 from the second hydraulic pump 3. On the other hand, when the pilot signal pressure for performing the arm-out driving operation is applied to the arm control valve 16, the controller 27 controls the secondary signal pressure that outputted from the pressure reduction valve 25 to be reduced so that the priority control valve 21 is shifted to a throttle release state to maximally switch the flow path 29 along which the hydraulic fluid from the second hydraulic pump 3 is supplied to the arm control valve 16.

Thus, a part of the hydraulic fluid discharged from the second hydraulic pump 3 is supplied to the swing motor 13 via the swing control valve 14 along the second center bypass path 12 to cause the swing motor to be driven. At the same time, a part of the hydraulic fluid discharged from the second hydraulic pump 3 is supplied to a small chamber of the arm cylinder 15 via the following paths: the second center bypass path 12→the parallel flow path 12*a*→the priority control valve 21 of the throttle release state→the flow path 29→the arm control valve 16.

As described above, according to the priority control system in accordance with the fourth embodiment of the present invention, when the swing operation and the arm-out driving operation are simultaneously performed, the spool of the priority control valve 21 can be shifted to the throttle release state or the throttle state by pressure reduction valve 25.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

INDUSTRIAL APPLICABILITY

As described above, according to the priority control system for a construction machine in accordance with the first to fourth embodiments of the present invention, when a swing apparatus of an excavator and a work apparatus or an attachment such as the arm are simultaneously manipulated, the priority control valve is shifted to a throttle state or a throttle release state depending on the amount of a load occurring in the hydraulic actuator so that simultaneous manipulability is maintained or an unnecessary pressure loss is prevented. In addition, the operating speed of the actuator can be secured to optimally control the distribution of the hydraulic fluid.

The invention claimed is:

1. A priority control system for a construction machine, comprising:

an engine;

first and second variable displacement hydraulic pumps connected to the engine and a pilot pump;

a boom control valve configured to control the drive of a boom cylinder, a bucket control valve configured to control the drive of a bucket cylinder, and a first traveling control valve configured to control the drive of a left traveling motor, wherein the boom control valve, the bucket control valve, and the first traveling control valve are installed in a first center bypass path of the first hydraulic pump so as to be connected to each other through a first parallel flow path;

a swing control valve configured to control the drive of a swing motor, an arm control valve configured to control the drive of an arm cylinder, and a second traveling control valve configured to control the drive of a right traveling motor, wherein the swing control valve, the arm control value, and the second traveling control valve are installed in a second center bypass path of the second hydraulic pump so as to be connected to each other through a second parallel flow path;

first and second pressure generation devices configured to output a control signal corresponding to a manipulation amount, respectively;

a shuttle valve configured to output a selected first pilot signal pressure applied to the swing control valve so that the swing motor can be swung in a left or right direction in response to the manipulation of the first pressure generation device; and a priority control valve installed in a flow path between the second parallel flow path on the second hydraulic pump side and an inlet port of the arm control valve, and configured to be switched between a throttle state and a throttle release state, wherein the priority control valve is shifted to the throttle state by the first pilot signal pressure output from the shuttle valve when a swing operation of a first actuator and an arm-in driving operation of a second actuator are simultaneously performed, and the priority control valve is shifted to the throttle release state by the elastic force of a valve spring of the priority control valve and a second pilot signal pressure applied to the priority control valve opposing the first pilot signal pressure, the second pilot signal pressure being applied to the arm control valve to perform an arm-out driving operation of the second actuator when the swing operation and the arm-out driving operation are simultaneously performed.

2. The priority control system according to claim 1, wherein the first actuator is the swing motor, and the second actuator is the arm cylinder.

3. A priority control system for a construction machine, comprising:

an engine;

first and second variable displacement hydraulic pumps connected to the engine and a pilot pump;

a boom control valve configured to control the drive of a boom cylinder, a bucket control valve configured to control the drive of a bucket cylinder, and a first traveling control valve configured to control the drive of a left traveling motor, wherein the boom control valve, the bucket control valve, and the first traveling control valve are installed in a first center bypass path of the first hydraulic pump so as to be connected to each other through a first parallel flow path;

a swing control valve configured to control the drive of a swing motor, an arm control valve configured to control the drive of an arm cylinder, and a second traveling control valve configured to control the drive of a right traveling motor, wherein the swing control valve, the arm control value, and the second traveling control valve are installed in a second center bypass path of the second hydraulic pump so as to be connected to each other through a second parallel flow path;

first and second pressure generation devices configured to output a control signal corresponding to a manipulation amount, respectively;

a shuttle valve configured to output a selected first pilot signal pressure applied to the swing control valve so that the swing motor can be swung in a left or right direction in response to the manipulation of the first pressure generation device;

a priority control valve installed in a flow path between the second parallel flow path on the second hydraulic pump side and an inlet port of the arm control valve, and configured to be switched between a throttle state and a throttle release state, wherein the priority control valve is shifted to the throttle state by the first pilot signal pressure output from the shuttle valve when a swing operation of a first actuator and an arm-in driving operation of a second actuator are simultaneously performed, and the priority control valve is shifted to the throttle release state by the elastic force of a valve spring of the priority control valve and a second pilot signal pressure applied to the priority control valve opposing the first pilot signal pressure, the second pilot signal pressure being applied to the arm control valve to perform an arm-out driving operation of the second actuator when the swing operation and the arm-out driving operation are simultaneously performed; and a signal line shutoff valve installed in a flow path between the shuttle valve and the priority control valve and configured to shut off the flow path only by the second pilot signal pressure that is applied to the arm control valve to perform the arm-out driving operation in response to the manipulation of the second pressure generation device.

4. A priority control system for a construction machine, comprising:

an engine;

first and second variable displacement hydraulic pumps connected to the engine and a pilot pump;

a boom control valve configured to control the drive of a boom cylinder, a bucket control valve configured to control the drive of a bucket cylinder, and a first traveling control valve configured to control the drive of a left traveling motor, wherein the boom control valve, the bucket control valve, and the first traveling control valve are installed in a first center bypass path of the first hydraulic pump so as to be connected to each other through a first parallel flow path;

a swing control valve configured to control the drive of a swing motor, an arm control valve configured to control the drive of an arm cylinder, and a second traveling control valve configured to control the drive of a right traveling motor, wherein the swing control valve, the arm control value, and the second traveling control valve are installed in a second center bypass path of the second hydraulic pump so as to be connected to each other through a second parallel flow path;

first and second pressure generation devices configured to output a control signal corresponding to a manipulation amount, respectively;

a shuttle valve configured to output a selected first pilot signal pressure applied to the swing control valve so that the swing motor can be swung in a left or right direction in response to the manipulation of the first pressure generation device;

a priority control valve installed in a flow path between the second parallel flow path on the second hydraulic pump side and an inlet port of the arm control valve, and configured to be switched between a throttle state and a throttle release state, wherein the priority control valve is shifted to the throttle state by the first pilot signal pressure output from the shuttle valve when a swing operation of a first actuator and an arm-in driving operation of a second actuator are simultaneously performed, and the priority control valve is shifted to the throttle release state by the elastic force of a valve spring of the priority control valve and a second pilot signal pressure applied to the priority control valve opposing the first pilot signal pressure, the second pilot signal pressure being applied to the arm control valve to perform an arm-out driving operation of the second actuator when the swing operation and the arm-out driving operation are simultaneously performed;

a signal line shutoff valve installed in a flow path between the shuttle valve and the priority control valve and configured shifted to shut off the flow path in response to an external electric control signal;

a first pressure detection means configured to detect the second pilot signal pressure that is applied to the arm control valve and output a detection signal to perform the arm-out driving operation in response to the manipulation of the second pressure generation device; and a controller configured to output an electric control signal to the signal line shutoff valve to shift the signal line shutoff valve when the second pilot signal pressure for performing the arm-out driving operation reaches a set value in response to the detection signal applied thereto from the first pressure detection means.

5. The priority control system according to claim 4, wherein a solenoid valve that is shifted in response to the electric control signal applied thereto from the controller is used as the signal line shutoff valve.

6. The priority control system according to claim 4, wherein the first pressure detection means includes a pressure sensor that detects the second pilot signal pressure applied to the arm control valve and transmits the detection signal to the controller.

7. The priority control system according to claim 4, wherein a pressure switch, which is turned on/off to generate a signal when the second pilot signal pressure applied to the arm control valve reaches the set pressure, is used as the first pressure detection means.

8. A priority control system for a construction machine, comprising:

an engine;

first and second variable displacement hydraulic pumps connected to the engine and a pilot pump;

a boom control valve configured to control the drive of a boom cylinder, a bucket control valve configured to control the drive of a bucket cylinder, and a first traveling control valve configured to control the drive of a left traveling motor, wherein the boom control valve, the bucket control valve, and the first traveling control valve are installed in a first center bypass path of the first hydraulic pump so as to be connected to each other through a first parallel flow path;

a swing control valve configured to control the drive of a swing motor, an arm control valve configured to control the drive of an arm cylinder, and a second traveling control valve configured to control the drive of a right traveling motor, wherein the swing control valve, the arm control value, and the second traveling control valve are installed in a second center bypass path of the second hydraulic pump so as to be connected to each other through a second parallel flow path;

first and second pressure generation devices configured to output a control signal corresponding to a manipulation amount, respectively;

a shuttle valve configured to output a selected first pilot signal pressure applied to the swing control valve so that the swing motor can be swung in a left or right direction in response to the manipulation of the first pressure generation device;

a priority control valve installed in a flow path between the second parallel flow path on the second hydraulic pump side and an inlet port of the arm control valve, and configured to be switched between a throttle state and a throttle release state, wherein the priority control valve is shifted to the throttle state by the first pilot signal pressure output from the shuttle valve when a swing operation of a first actuator and an arm-in driving operation of a second actuator are simultaneously performed, and the priority control valve is shifted to the throttle release state by the elastic force of a valve spring of the priority control valve and a second pilot signal pressure applied to the priority control valve opposing the first pilot signal pressure, the second pilot signal pressure being applied to the arm control valve to perform an arm-out driving operation of the second actuator when the swing operation and the arm-out driving operation are simultaneously performed;

a pressure reduction valve installed in a flow path between the pilot pump and the priority control valve;

a first pressure detection means configured to detect the second pilot signal pressure that is applied to the arm control valve and output a detection signal to perform the arm-out driving operation in response to the manipulation of the second pressure generation device;

a second pressure detection means configured to detect the first pilot signal pressure that is output from the shuttle valve which outputs a selected first pilot signal pressures applied to the swing control valve, and output a detection signal so that the swing motor is driven in a left or right direction in response to the manipulation of the first pressure generation device; and a controller configured to output a control signal to the pressure reduction valve to increase a secondary signal pressure that is output from the pressure reduction valve when a swing pilot signal pressure is increased by the detection signal applied thereto from the second pressure detection means, and to reduce the secondary signal pressure that is output from the pressure reduction valve when the second pilot signal pressure for performing the arm-out driving operation is applied to the arm control valve by the detection signal applied thereto from the first pressure detection means.

9. The priority control system according to claim 8, wherein an electro proportional control valve for varying the secondary signal pressure output therefrom in response to the electric control signal value applied thereto is used as the pressure reduction valve.

10. The priority control system according to claim 8, wherein the first and second pressure detection means include pressure sensors for detecting the first or the second pilot signal pressure applied to the arm control valve and outputting the detection signal for application to the controller.

11. The priority control system according to claim 8, wherein pressure switches, which are turned on/off to generate a signal when the first or the second pilot signal pressure applied to the arm control valve reaches the set pressure, are used as the first and second pressure detection means.

* * * * *